United States Patent [19]

Buzzella et al.

[11] 4,023,582

[45] May 17, 1977

[54] VENTED METAL UMBRELLA KIT

[76] Inventors: Robert W. Buzzella; Howard O. Biggers, both of 630 W. 84th St., Miami, Fla. 33014

[22] Filed: Apr. 5, 1976

[21] Appl. No.: 673,382

[52] U.S. Cl. ..... 135/20 R; 52/73; 52/82; 52/473; 135/27

[51] Int. Cl.[2] ..... A45B 11/00

[58] Field of Search ..... 135/20 R, 27, 28, 38, 135/39, 40; 52/73, 82, 473

[56] References Cited

UNITED STATES PATENTS

| | | | |
|---|---|---|---|
| 2,466,595 | 4/1949 | Korman | 52/73 |
| 2,485,118 | 10/1949 | Simpson | 135/20 R |
| 2,546,099 | 3/1951 | Jamison et al. | 135/20 R X |
| 2,577,317 | 12/1951 | Eschrich | 52/82 X |
| 3,345,786 | 10/1967 | Buzzella et al. | 52/73 |
| 3,454,022 | 7/1969 | Ferguson | 135/20 R |

*Primary Examiner*—Werner H. Schroeder
*Assistant Examiner*—Conrad L. Berman
*Attorney, Agent, or Firm*—Ernest H. Schmidt

[57] ABSTRACT

A vented metal umbrella kit comprising a pair of substantially diametrically divided, prefabricated canopy half-sections, each half-section of which is prefabricated of a plurality of elongated sheet metal channel members tapered from end to end and secured in relatively side to side, interstraddling, fan-like relative disposition, a vertical support structure having a support arm adjustably secured at one end and a support disc removably attachable to the outer end of the support arm, means securing the umbrella half-sections in depending relation about the support disc, and a cone member of greater diameter than the support disc removably securable over the support disc and the attached end portions of the canopy half-sections assembled thereto.

6 Claims, 15 Drawing Figures

22
21
46
17
18
51
45
35
19
15
20
19
19
20
19
44
27
12
11
13
14
10
16
52
53
72
19
72
73
73
70
68
80
81
20
20
81
80
72
73
73
70
72
67
52
53
60
16

VENTED METAL UMBRELLA KIT

In our U.S. Pat. No. 3,345,786 issued Oct. 10, 1967 entitled Vented Metal Umbrella there is described a vented metal umbrella kit in which the canopy is prefabricated in four sections for knock-down shipment in kit form. The present invention is directed to improvements in that umbrella structure enabling prefabrication of the canopy in two sections, whereby assembly from the kit will be greatly simplified while at the same time simplifying and economizing the manufacture of the umbrella kit for compact shipment as a kit.

It is accordingly the principal object of the invention to provide an umbrella kit of the character described in which the individual parts of the kit and their interconnecting and fastening means are kept simple and few in number to assure ease of assembly by anyone capable of using simple hand tools such as a screw driver and a pair of pliers.

Another object of the invention is to provide a vented metal umbrella kit of the above nature, the component parts of which can readily be manufactured for the most part of a light-weight metal such as aluminum and which, when assembled, will provide an exceptionally strong and durable umbrella structure.

Yet another object is to provide an umbrella kit of the above nature which, when assembled, cannot be distinguished from a factory finished umbrella, which will be attractive in appearance, easy to adjust as to height and inclination, and otherwise well suited to its use and purposes.

Other objects, features and advantages will be apparent from the following description when read with reference to the accompanying drawings. In the drawings, wherein like reference numerals denote corresponding parts throughout the several views.

Figures 1, 2:
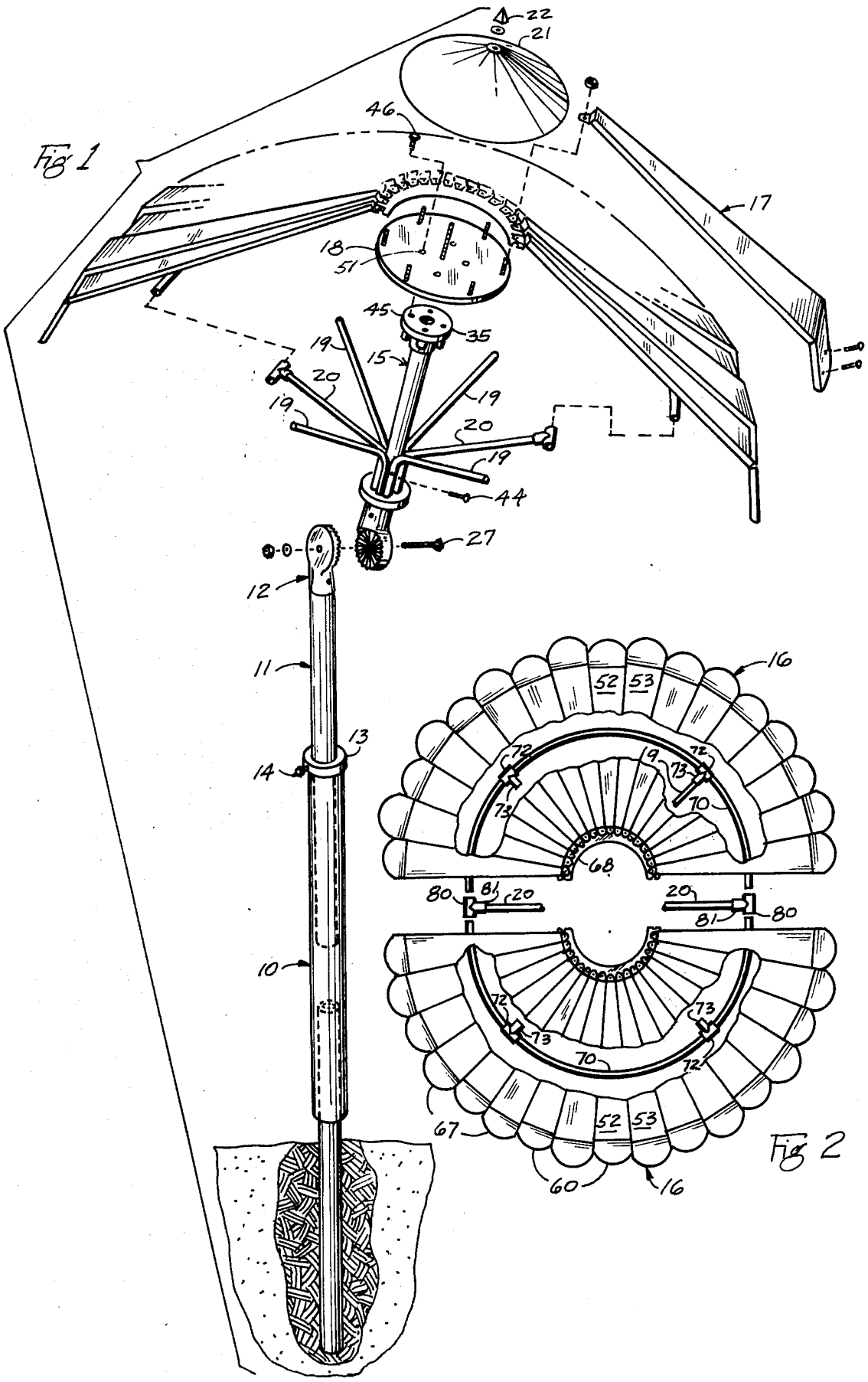
FIG. 1 illustrates, in elevation, portions of an umbrella kit embodying the invention shown in partially assembled and partially exploded relation.
FIG. 2 is a top view of the umbrella canopy half-sections; illustrating details of their construction and interassembly.
Figure 3:
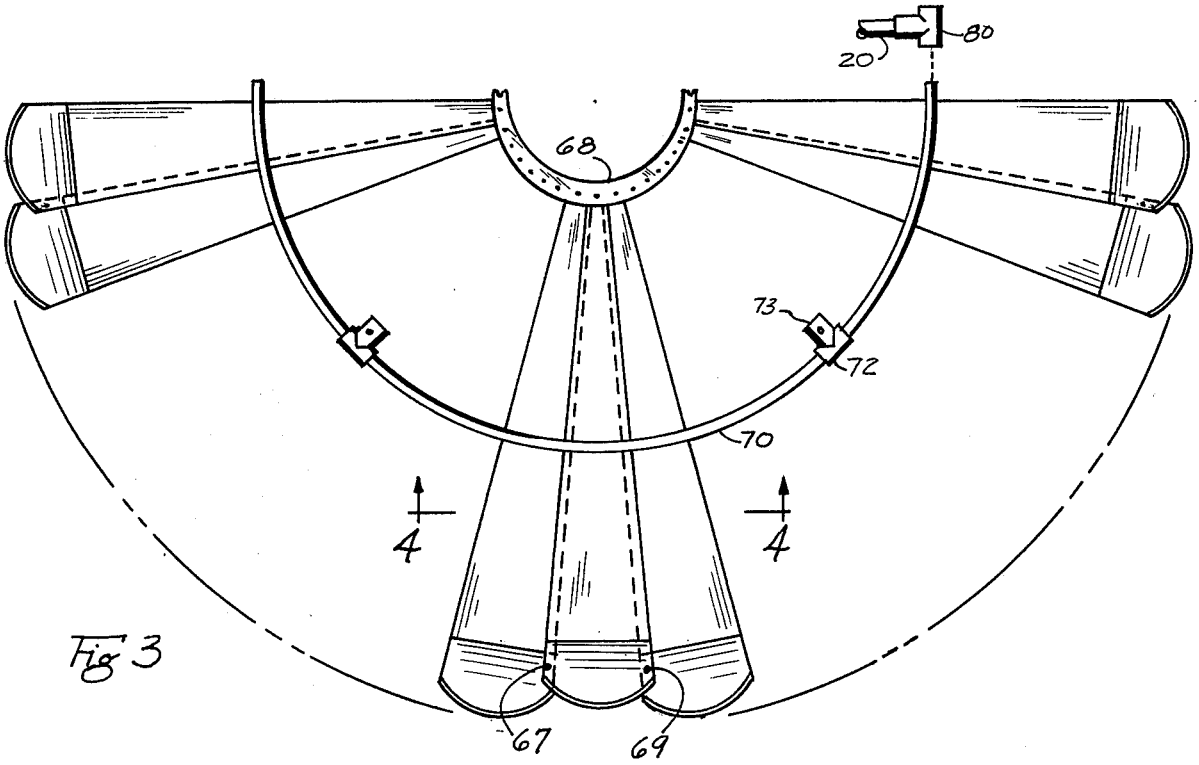
FIG. 3 is a partial inside view of one of the prefabricated umbrella canopy half-sections.
Figure 4:
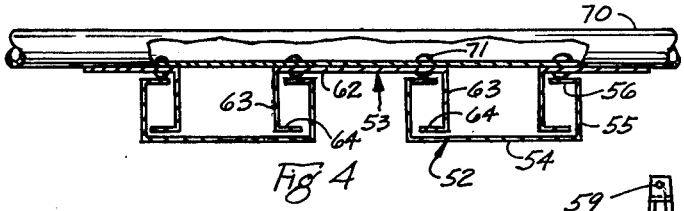
FIG. 4 is a fragmentary transverse cross-sectional view taken along the line 4—4 of FIG. 3 in the direction of the arrows, and illustrating details of assembly of the umbrella half-sections.
Figure 5:
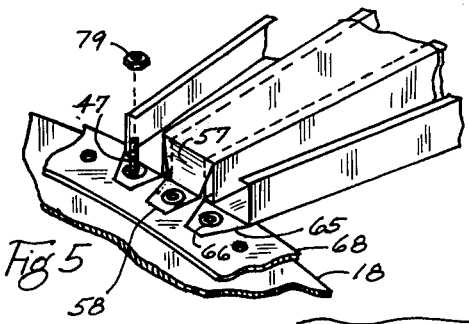
FIG. 5 is a partial oblique view illustrating the prefabricated assembly of the inner ends of the canopy half-section channel members to their arcuate connector member, and the subsequent assembly of the half-sections to the support disc upon erection of the kit.
Figure 8:
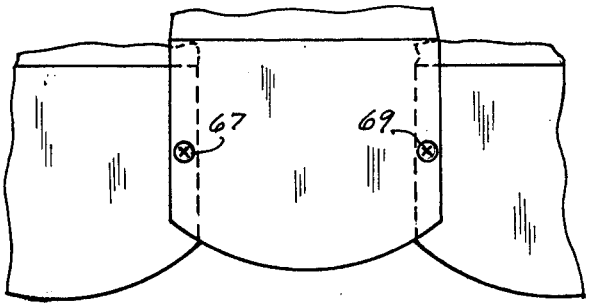
FIG. 8 is a fragmentary, enlarged view of the outer end valance portions of the tapered channel members, illustrating the machine screw interconnection thereof.
Figure 6:
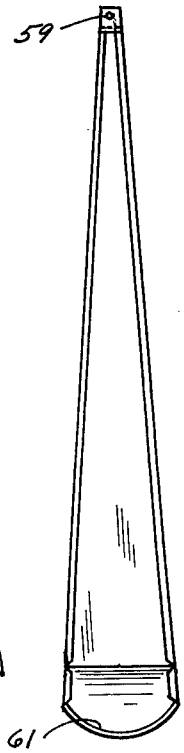
FIG. 6 is an inside view of one of the tapered channel members of a half-section.

Referring how in detail to the drawings, the umbrella kit embodying the invention comprises, generally, a vertical support structure including a lower support pipe or tube 10, an upper support pipe or tube 11 telescopingly received within the upper end of the tube 10 and having affixed at its upper end a knuckle member 12, and a collar 13 located at the end of tube 10 and having a set-screw 14 extending through an opening in said tube for adjustably securing the upper support tube 11. The kit also comprises, generally, an adjustable knuckle arm 15, two umbrella canopy half-sections 16, two separate tapered channel members 17, an umbrella canopy support disc 18, a first set of four radial support arms 19, a second set of two radial support arms 20, an umbrella cover cone 21, a pyramid finial 22 and a small number of nuts, bolts and screws as is hereinafter more particularly described.

The knuckle member 12 at the upper end of the upper support tube 11 is preferably cast of a light-weight metal, such as a strong aluminum alloy, and comprises a cylindrical body portion 23 integrally formed at the upper end and at one side with a cylindrical head portion 24 the axis of symmetry of which is perpendicular to that of said body portion. The inside of the head portion 24 is formed with radially-extending, tapered, triangular grooves 25 and axial opening or bore 26 for receiving an interconnecting and adjustment bolt 27. The lower end of the cylindrical body portion 23 is formed with an internally threaded axial opening within which the upper threaded end 29 of the support tube 11 is threadingly received and further secured as by a set screw 30.

Figure 10:
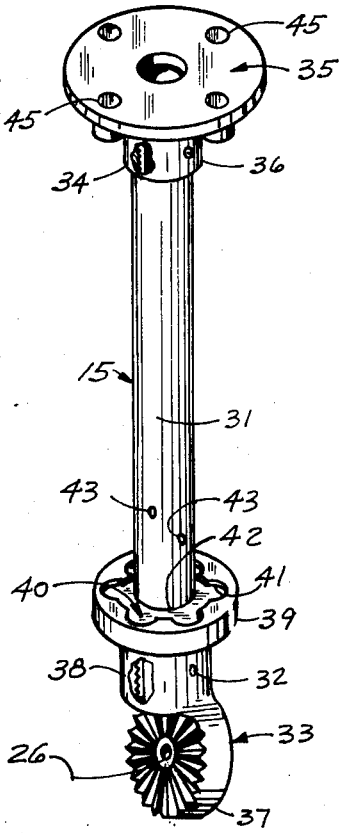
FIG. 10 is a perspective view of the adjustable knuckle arm, shown separately.
Figure 11:
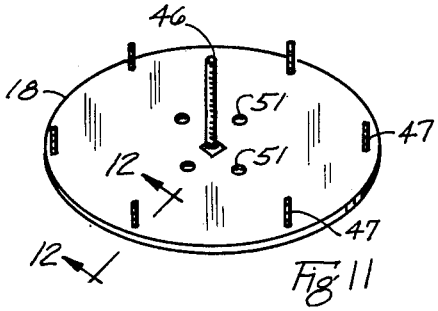
FIG. 11 is a perspective view, as seen from the top, of the umbrella canopy support disc, shown separately.

As is best illustrated in FIG. 10, the adjustable knuckle arm 14 comprises a comparatively short pipe or tube 31, preferably of the same diameter as that of the upper support tube 11, having screw-threaded thereon and further secured thereto, as by set screw 32, a knuckle and support member 33. At the upper end, the tube 31 is threadingly engaged within the hub 34 of a circular flange 35, and is further secured as by set screw 36. The knuckle and support member 33 is also preferably cast of a strong aluminum alloy, and is generally similar in size and form to the knuckle member 12, differing only in that the head portion 37 is recessed at the outside to receive the head of interconnecting bolt 27 and in that body portion 38 is provided with means for mechanically supporting the inner ends of the radial support arms. To this end, the body portion 38 has integrally cast, at the outer end thereof, a coaxial cylindrical collar portion 39 of substantially increased diameter which, in its outer end, is formed with a recess 40 defined by six inwardly-facing, substantially semi-circular wall portions 41 symmetrically arranged about the central opening or bore 42 within which the lower end of the tube 31 is threaded. The tube 31 is provided with tapped openings 43 in vertical alignment with each of the semi-circular wall portions 41 of the recess 40 and alternately vertically staggered thereabout for receiving bolts 44 securing the radial support arms in assembly of the umbrella kit, as illustrated in FIG. 1 and as is herein below more particularly described.

The circular flange 35, which also may be of a cast aluminum alloy for lightness and strength, is integrally formed at its underside with the central, tubular hub portion 34 within which the upper end of the tube 31 is fixed, and is provided with four equidistantly-spaced, axially-extending tapped openings 45 for the reception of machine screws 46 (see FIG. 1).

Figure 12:
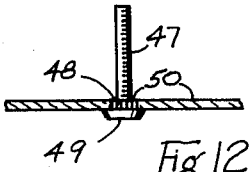
FIG. 12 is a vertical cross-sectional view taken along the line 12—12 of FIG. 11 in the direction of the arrows.
Figure 13:
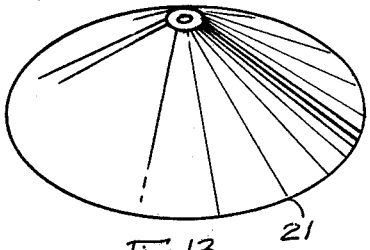
FIG. 13 is a perspective view, as seen from the top, of the umbrella canopy cover cone, shown separately.
Figure 14:
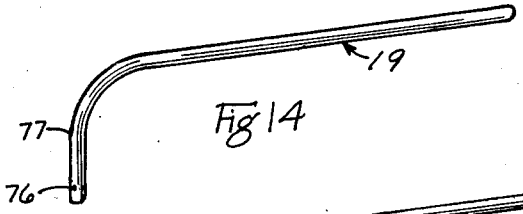
FIG. 14 is a perspective view of one of the umbrella canopy radial support arms utilized for half-section support.
Figure 15:
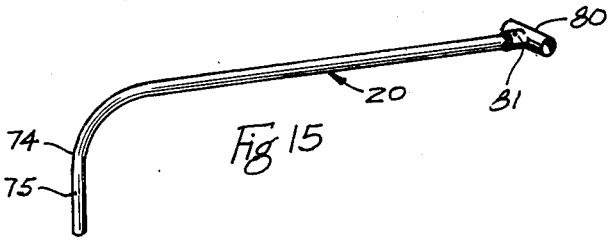
FIG. 15 is a perspective view of one of the umbrella canopy radial support arms equipped with a connector fitting for umbrella canopy support at the juncture of two half-sections.

The umbrella support disc 18 is stamped or otherwise formed of aluminum alloy sheet and is circular in form. The support disc 18 has secured thereto a central upstanding threaded stud 46 and six peripherally-arranged, equidistantly-spaced, upstanding, comparatively short, threaded studs 47. The threaded studs 47 as illustrated in FIG. 12 are formed with reduced-diameter portions 48 under the flattened bolt heads 49, which reduced diameter portions are peripherally serrated for press-fit within appropriate undersize openings 50 in the disc 18. The support disc 18 is also provided with four openings 51 equidistantly-spaced from the center of said disc and from each other, and so positioned as to receive the threaded studs 46 of the flange 35 during assembly of the umbrella kit, as is hereinbelow more fully described. In this connection, it is to be noted that the flange 35 is so circularly oriented on the tube 31 with respect to the knuckle and support member 33 that when the disc 18 is assembled thereto as hereinabove mentioned, the tapped openings 43 in said tube will be in axial alignment with one each of the studs 47 in said disc.

As illustrated in FIG. 2, the umbrella canopy half-sections are fabricated of upper and lower longitudinally-tapered channel members 52 and 53, respectively, alternately arranged in fan-like disposition. The upper channel members 52 are preferably stamped of a light-weight metal, such as sheet aluminum, and are integrally formed with elongated, tapered top wall portions 54, and downwardly-turned side wall portions 55 which terminate in relatively short, opposed inwardly-turned portions 56. The top wall portions 54 at the inner or narrow ends are provided with downwardly and outwardly turned portions 57 and 58, respectively, said outwardly turned portions being provided with apertures 59 for receiving securing rivets or other fastening means, as is hereinbelow described. The outer or wide ends of the upper channel members 52 are provided with downwardly-turned valance portions 60, the outer edges of which are arcuately cut to present a scalloped appearance. The outer edges of the valance portions 60 are also backwardly bent to provide a rounded bead 61 thereat.

The lower channel members 53 are similar in shape to the upper channel members 52, being integrally formed with elongated, tapered bottom wall portions 62, and upwardly-turned side wall portions 63 which terminate in relatively short, opposed, inwardly-turned portions 64. The bottom wall portions 62 at their inner or narrow ends are provided with short, extended portions 65 provided with apertures 66 for the reception of fastening rivets, as hereinbelow described. The outer or wide ends of the lower channel members are also provided with downwardly-turned valance portions 67, also scalloped and beaded as at 61.

The half-panels are prefabricated at the factory, and, as illustrated in FIGS. 2, 3, 4, 5 and 9, the upper and lower channel members 52 and 53 thereof are secured in assembled relation at their inner ends by riveting to an arcuate connector plate 68 and, at their outer ends, by bolts with self-locking plastic nuts 69 extending through overlapping top and bottom wall portions in the valances of adjacent ones of said upper and lower channel members. Each half-section 16 also has fixed laterally along its underside an arcuate tube 70, said tube being attached to the lower channel members 53 by rivets 71 (FIG. 4) so placed as to be hidden by upper channel members 52. Spaced along the arcuate tube 70 of each half-section 16 are a pair of T-connector fittings 72, each having an outwardly-extending arm 73 for reception of one of the radial support arms 19 in the assembly of the umbrella kit, as is hereinbelow described. The ends of the arcuate tubes 70 project by a short distance beyond each side of the outside lower channel members 53. Similarly, the ends of the arcuate connector plate 68 project slightly beyond each side of the outside lower channel members 53.

Figure 7:
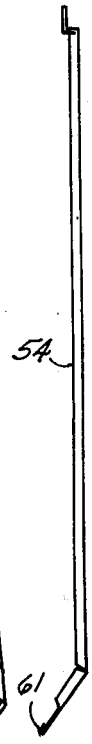
FIG. 7 is a side view thereof.
Figure 9:
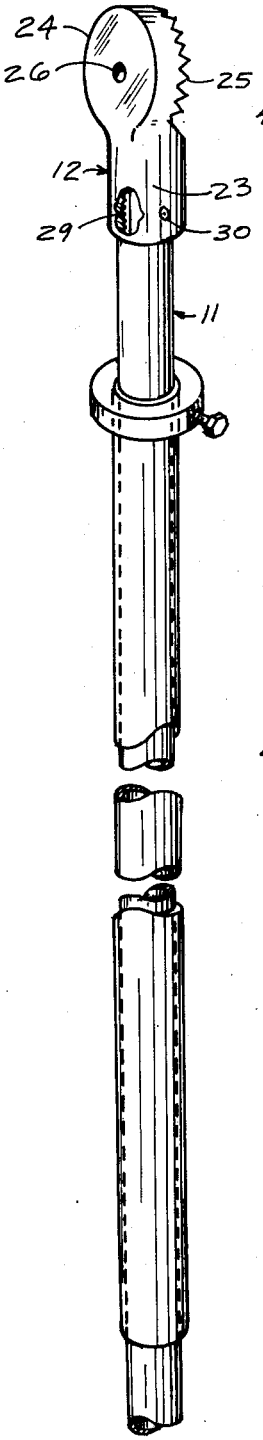
FIG. 9 is a perspective view, with portions broken away, of the vertical support structure of the umbrella canopy.

The umbrella kit above described is assembled by first placing the lower support tube 10 down upon a length of pipe P secured in the ground at the site (FIG. 1) and then inserting the upper support tube 11 in said lower support tube with the collar 13 secured near the upper end thereof as by set screw 14. The knuckle arm 15 will then be secured to the upper end of the upper support tube 11 by the bolt 27 extending through the head portions 24 and 37 thereof, said knuckle arm being adjusted in inclined position to one side to facilitate assembly of the umbrella canopy half-sections 16. The support disc 18 will next be fitted upon the upper end of the flange 35 of the knuckle arm 15, and secured by bolts 46 extending through the openings 51 in said support disc, and threaded in tapped openings 45. The down-turned ends 74 of the two radial support arms 20 will next be placed in diametrically-opposed semi-circular portions of the recess 40 in the knuckle and support member collar portion 39 and secured in place by bolts 44 extending through openings 75 in said down-turned ends and threaded in the tapped openings 43 in the tube 31. The first half-section 16 will then be placed between two of the support arms 20 with central openings 76 and end half-openings 77 and 78 thereof receiving the pertaining four threaded stud bolts 47 of the support disc 18. At this time, two nuts 79 will be used on the central stud bolts 47 to hold the half-section 16 in place. Next, the remaining half-section 16 will be fitted in place in the same manner adjacent the first assembled half-section, and secured at its central stud bolts 47 with nuts 79. The T-connector fittings 80 secured at the outer ends of the radial support arms 20 as by set screws 81 receive the adjacent projecting end portions of the arcuate tubes 70 to hold them in interlocked relation. A tapered channel member 17 (FIGS. 1, 5, and 7) will then be slid upwardly in place in closing relationship over the gap between the two assembled half-sections, said channel member being identical in construction with any one of the upper channel members 52 of the half-sections 16, and secured in place at its inner end by a nut 76 threaded on the stud bolt 47 at the juncture of the two half-sections, and at its outer or valance end, by bolts with plastic lock nuts 69 joining with marginal portions of the adjacent lower channel members 53 of the side-by-side half-sections.

The radial support arms 19 will next be assembled by placing their outer ends in the arm sockets 73 of the T-connector fittings 72 and their inner ends in their respective semi-circular portions of the recess 40 in the collar portion 39 of the adjustable knuckle arm 14 after which bolts 44 will be placed through openings 76 in the down-turned ends 77 of said support arms and secured in the tapped openings 43 in the tube 31 of said knuckle arm. Assembly is completed by fitting the cover cone 21 over the top of the umbrella, a central opening 82 being provided therein for passage of the central threaded stud 46 of the support disc 18, and securing said cover cone in place by means of the screw-on finial 22. The cover cone 22 completely covers the umbrella support disc 18 and the inner ends of the half-sections 16, giving an attractive finished appearance to the umbrella.

In use, height of the umbrella is controlled simply by adjusting the position of the upper support tube 11 in the lower support tube 10 and then tightening the set-screw 14 on the collar 13, while its inclination is controlled by adjusting the angular position of the knuckle arm 15 with respect to the knuckle member 12 at the upper end of said support tube by means of the adjustment bolt 27.

While we have illustrated and described herein only one form in which our invention may conveniently be embodied in practice, it is to be understood that this form is given by way of example only and not in a limiting sense. The invention, in brief, comprises all the modifications and embodiments coming within the scope and spirit of the following claims.

What We claim as new and desire to secure by Letters Patent is:

1. An umbrella comprising, in combination, a vertical support structure, a support arm adjustably secured at one end to the upper end of said vertical support structure, an umbrella disc secured to the other end of said support arm, a pair of umbrella canopy half-sections, each substantially in the shape of a half sector of a circle having its apex end truncated along an arc concentric with its origin, means securing said umbrella half-sections in side-by-side depending relation about said support disc with their apex ends secured to said support disc, a cone member of greater diameter than said support disc secured over said support disc and inner end portions of said umbrella canopy half-sections, brace mechanism supporting inside portions of said umbrella canopy half-sections with respect to lower end portions of said support arm, said brace mechanism comprising a plurality of tubular radial arms, a cylindrical collar member provided at the lower end of said support arm, said collar member having in its upper end a plurality of peripherally-arranged arcuate recesses, one for each of said radial arms, each arm having at one end a down-turned end portion seated one each in said arcuate recesses, means securing the other end of each of said radial arms to radial mid-portions of said umbrella half canopy half-sections, said brace mechanism further comprising tubular members fixed against the underside of each said umbrella canopy half-sections in concentric relation thereto, and T-connector fittings secured to said arcuate tubular members and having sockets seating the other ends of said radial arms, and means securing said down-turned end portions of said radial arms to said support arm, said support arms securing means comprising a plurality of screw-threaded openings in said support arm and bolts extending through diametrical openings in said down-turned end portions and received one each in said threaded openings.

2. An umbrella as defined in claim 1 wherein said plurality of screw-threaded openings in said support arm are peripherally spaced and alternately vertically staggered about and along said support arm.

3. An umbrella as defined in claim 2, wherein in each of said umbrella canopy half-sections comprises a plurality of metal channel members tapered from end to end and secured in side-to-side, fan-like relative disposition, said channel members comprising a plurality of top channel members and plurality of bottom channel members, said top and bottom channel members each having a top wall portion, opposed side wall portions, and inwardly-turned portions at the outer ends of said side wall portions, said top and bottom channel members being interspaced and relatively inverted.

4. An umbrella kit comprising, in combination, a vertical support structure, a support arm, means for removably securing one end of said support arm to the upper end of said support structure, an umbrella support disc removably securable to the other end of said support arm, a plurality of umbrella canopy half-sections, each substantially in the shape of a half sector of a circle having its apex end truncated along an arc concentric with its origin, means for removably securing said umbrella canopy half sections in side-by-side, spaced, depending relation about said support disc and to said support disc at their apex ends, a cone member of greater diameter than said support disc removably securable over said support disc, a plurality of brace members removably securable between inside portions of said umbrella canopy half-sections and lower end portions of said support arm, said brace mechanism comprising a plurality of tubular radial arms, a cylindrical collar member provided at the lower end of said support arm, said collar member having in its upper end a plurality of peripherally arranged arcuate recesses, one for each of said radial arms, said radial arms, said radial arms each having at one end down-turned portions seatable one each in said arcuate recesses, and means securing the other end of said radial arms to radial mid-portions of said umbrella canopy half-sections, said brace mechanism further comprising tubular members fixed against the underside of each of said umbrella canopy half-sections in concentric relation thereto, and T-connector fittings secured to said arcuate tubular members and having sockets seating the other ends of said radial arms and further including means securing said down-turned end portions of said radial arms to said support arm, said support arms securing means comprising a plurality of screw-threaded openings in said support arm and bolts extending through diametrical openings in said down-turned end portions and received one each in said threaded openings.

5. An umbrella kit as defined in claim 4 wherein said plurality of screw-threaded openings in said support arm are peripherally spaced and alternately vertically staggered about and along said support arm.

6. An umbrella kit as defined in claim 5, wherein in each of said umbrella canopy half-sections comprises a plurality of metal channel members tapered from end to end and secured in side-to-side, fan-like relative disposition, said channel members comprising a plurality of top channel members and plurality of bottom channel members, said top and bottom channel members each having a top wall portion, opposed side wall portions, and inwardly-turned portions at the outer ends of said side wall portions, said top and bottom channel members being interspaced and relatively inverted.

* * * * *